US005632785A

United States Patent [19]

Culotta

[11] Patent Number: 5,632,785

[45] Date of Patent: May 27, 1997

[54] FUEL ECONOMY ADDITIVES

[75] Inventor: Anne M. Culotta, Houston, Tex.

[73] Assignee: Exxon Research & Engineering Company, Florham Park, N.J.

[21] Appl. No.: 566,457

[22] Filed: Dec. 1, 1995

[51] Int. Cl.[6] ..... C10L 1/18

[52] U.S. Cl. ..... 44/389; 44/397

[58] Field of Search ..... 44/389

[56] References Cited

U.S. PATENT DOCUMENTS

| | | | |
|---|---|---|---|
| 2,527,889 | 10/1950 | Moore et al. | 44/389 |
| 2,891,089 | 6/1959 | Jolly | 44/389 |
| 3,222,146 | 12/1965 | Case et al. | 44/389 |
| 3,542,678 | 11/1970 | Bork | 44/389 |
| 3,637,774 | 1/1972 | Babayan et al. | 260/410.6 |
| 3,672,854 | 6/1972 | Rosenwald et al. | 44/389 |
| 3,713,792 | 1/1973 | Wiley | 44/389 |
| 3,953,179 | 4/1976 | Souillard et al. | 44/389 |
| 4,609,376 | 9/1986 | Craig et al. | 44/389 |
| 4,617,026 | 10/1986 | Shaub et al. | 44/70 |
| 4,920,691 | 5/1990 | Fainman | 44/57 |

FOREIGN PATENT DOCUMENTS

| | | |
|---|---|---|
| 0227218 | 7/1987 | European Pat. Off. . |
| 0608149 | 7/1994 | European Pat. Off. . |

*Primary Examiner*—Ellen M. McAvoy
*Attorney, Agent, or Firm*—Roy J. Ott

[57] ABSTRACT

A method for reducing fuel consumption in an internal combustion engine comprises operating said engine on a fuel composition comprising a major amount of fuel and a minor amount of an additive comprising an ester of a polyhydric polyether having ether oxygens and free and esterified hydroxyl groups in the polyhydric polyether backbone. One such ester additive is decaglycerol tetraoleate, which is an ester of decaglycerol and oleic acid containing an average of four adducted oleic acid units and 10–12 free hydroxyl groups.

13 Claims, No Drawings

FUEL ECONOMY ADDITIVES

BACKGROUND OF THE INVENTION

1. Field of the Invention

This invention relates to a method for reducing fuel consumption in an internal combustion engine. More particularly, this invention relates to a method for reducing fuel consumption in an internal combustion engine by incorporating an additive in the fuel to increase fuel economy and to a fuel composition for an internal combustion engine containing said additive, wherein the additive comprises an ester of a polyhydric polyether having ether oxygens and free and esterified hydroxyl groups in the polyhydric polyether backbone of the ester molecule.

2. Background of the Disclosure

There are continuing efforts to reduce fuel consumption in internal combustion engines for motor vehicles and for other applications. These include gasoline and diesel fuel powered engines. Considerable effort has been spent over the years in developing and improving friction reducing additives for the engine lubricating oil. These additives have included a wide variety of organic compounds, including compounds which contain one or more of metal, nitrogen and sulfur. Lubricating oil compositions containing fatty acid esters and amides, both sulfurized and unsulfurized, are disclosed, for example, in U.S. Pat. Nos. 4,201,684 and 5,154,844. In addition, many other additives are added to the oil such as antioxidants, detergents, dispersants, antiwear compounds, viscosifiers, pour point depressants, antifoam agents and the like. However, the improvements in fuel efficiency obtained with improvements in lubricating oil friction reducing additives have been modest and are typically difficult to ascertain without statistical testing in a number of internal combustion engines. Increasing effort is now being spent in developing fuel additives as friction modifiers to provide greater fuel economy by reducing friction in the combustion chamber of an internal combustion engine.

The development of additives for fuel has drawn on the experience gained with additives developed for lubricating oils, but the conditions in an internal combustion chamber are substantially different from, and much more sever than, those in a crankcase. Consequently, the fact that a particular additive or class of additives has benefited the performance of a lubricating oil in an internal combustion engine does not mean that benefits will be gained by using the same types of compounds as additives in the fuel. Fuel additives for increasing fuel economy in an internal combustion engine have included esters of fatty acids and polyhydric alcohols such as glycerol, as disclosed in U.S. Pat. No. 4,617,026. The '026 patent also discloses that fatty acid esters of a polyether such as a polyalkylene glycol have been used in lubricating oils.

SUMMARY OF THE INVENTION

It has now been found that the fuel consumption of an internal combustion engine can be reduced by using a fuel composition which contains a major amount of a fuel and a minor amount of an additive which is an ester of a polyhydric polyether having free and esterified hydroxyl groups in the polyether backbone. More particularly, the invention relates to a method for reducing the fuel consumption of an internal combustion engine which comprises operating said engine on a fuel composition comprising a major amount of fuel and a minor amount of said polyhydric polyether ester additive. In another embodiment, the invention relates to a fuel composition comprising a major amount of a fuel and a minor amount of said polyhydric polyether ester. As set forth above, the polyhydric polyether backbone portion of the ester molecule useful in the practice of the invention has free and esterified hydroxyl groups and ether oxygens. An illustrative, but nonlimiting example of a polyhydric polyether ester useful in the practice of the invention comprises a fatty acid ester of an oligomer of glycerol wherein the ester has both ether oxygens and free and esterified hydroxyls present in the oligomer backbone. The glycerol oligomer is a polyhydric polyether formed from the intercondensation of from three to ten glycerol molecules. In general, the number of free hydroxyls present is at least two, preferably at least three and still more preferably at least four. In one particular embodiment wherein the ester additive of the invention is a decaglycerol tetraoleate made by esterifying decaglycerol with oleic acid, the number of adducted oleic acid units is an average of four, with an average of 10 to 12 free hydroxyl groups in the decaglycerol backbone.

DETAILED DESCRIPTION

As set forth above, an essential feature of the invention relates to the use of a minor, but effective amount of an ester of a polyhydric polyether as a fuel additive. The polyhydric polyether backbone of the ester is also described as a polyhydroxyl-containing polyether and has both ether oxygen and hydroxyl groups as is explained in greater detail below. This combination of both ether oxygen and free hydroxyl groups in the polyhydric polyether backbone of the ester molecule distinguishes the ester additive of the invention from the prior art esters disclosed as additives for lubricating oils and fuels. By way of example, the '026 patent referred to above discloses mono- and diesters of glycerol and polyalkylene glycol which have the respective formulae of:

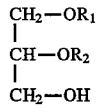

(A)

and

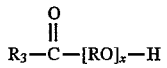

(B)

wherein $R_1$ and $R_2$ are the same or different, wherein one may be H and one or both may be derived from one or more 12 to 30 carbon atom monocarboxylic acids, acid halides, esters, anhydrides and mixture thereof, wherein x is 2 to 100 and wherein R is a 2 to 5 carbon atom straight chain alkane. $R_3$ is derived from a fatty acid. The first case (A) is simply a mono- or diester of glycerol. The second case (B) is an ester of a polyether with a terminal hydroxyl ending the polyether backbone. In marked contrast, the polyhydric polyether ester of the invention has ether oxygens and free and esterified hydroxyl groups present in the polyhydric polyether backbone as illustrated below:

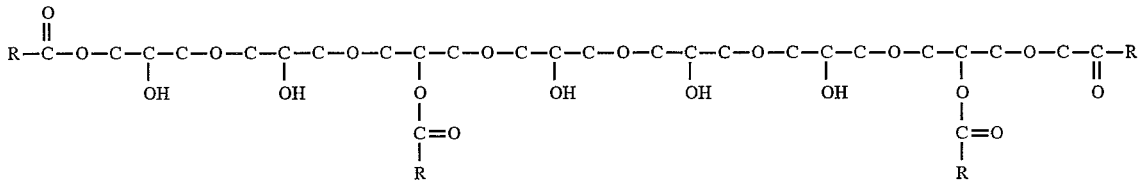

wherein the —[$CH_2CHOHCH_2O$]— and —[$CH_2CH(OR)CH_2O$]— repeat units have ether oxygens and free and esterified hydroxyl functionality present in the polyhydric polyether backbone and wherein the R groups are the same or different as described in detail below. In the simplified illustration shown above, there are four adducted carboxylic acid, —[C(O)R], units. Since there are seven glycerol derived groups in the polyhydric polyether glycerol oligomer backbone, it is heptaglycerol. If the four adducted groups are derived from oleic acid, it is a heptaglycerol tetraoleate with four adducted oleic acid units and five free hydroxyl groups on the polyhydric polyether backbone of the ester. Since oligomerization of glycerol occurs at both primary and secondary hydroxyl groups, this illustration is a somewhat simplified model of an ester of the invention which is merely intended to show both the ether oxygens and the free hydroxyl groups present in the oligomer backbone. Accordingly, it is to be taken as illustrative, but nonlimiting, with respect to the polyhydric polyether ester useful in the practice of the invention. While not wishing to be held to any particular theory, it is believed that the polyhydric polyether ester of the invention acts as a friction modifier to reduce friction in the combustion chamber of an internal combustion engine, as well as other parts of the fuel system.

Carboxylic acids useful for the purposes of the invention include aliphatic, cycloaliphatic, and aromatic mono- and polybasic carboxylic acids such as the napthenic acids, alkyl- or alkenyl-substituted cyclopentanoic acids, alkyl or alkenyl-substituted cyclohexanoic acids, alkyl- or alkenyl-substituted aromatic carboxylic acids. The aliphatic acids generally contain at least eight carbon atoms and preferably at least twelve carbon atoms. Generally, if the aliphatic carbon chain is branched, the acids are more hydrocarbon fuel soluble for any given carbon atoms content. The cycloaliphatic and aliphatic carboxylic acids can be saturated or unsaturated. Thus, the carboxylic acid or acids from which the ester of the invention is derived may be a mono or polycarboxylic acid such as aliphatic, saturated or unsaturated, straight or linear, or branched chain, with mono and dicarboxylic acids being preferred. For example, the acid may be generalized in the formula R'(COOH)x where x represents an integer and is 1 or more such as 1 to 4, and R' represents a hydrocarbyl group having from 4 to 50 carbon atoms and which is mono or polyvalent corresponding to the value of x, the —COOH groups, when more than one is present, optionally being substituent on different carbon atoms from one another. "Hydrocarbyl" means a group containing carbon and hydrogen which group is connected to the rest of the molecule via a carbon atom. It may be straight or branched chain which chain may be interrupted by one or more hetero atoms such as O, S, N, or P; it may be saturated or unsaturated; it may be aliphatic or alicyclic or aromatic, including heterocyclic, or it may be substituted or unsubstituted. Preferably, when the acid is monocarboxylic, the hydrocarbyl group is an alkyl group or an alkenyl group having 10 to 30 carbon atoms, i.e., the acid is saturated or unsaturated. The alkenyl group may have one or more double bonds, such as 1, 2 or 3. Examples of saturated and unsaturated carboxylic acids include those with 10 to 22 carbon atoms such as capric, lauric, myristic, palmitic, behenic, linoleic, isostearic, 2-ethylhexanoic, propylene-tetramer-substituted maleic, pelargonic, undecyclic, dioctocyclopentane carboxylic acid, dilauryldecahydronphthalene carboxylic acid, stearyloctahydroindane carboxylic acid, oleic, elaidic, palmitoleic, petroselic, ricinoleic, eleostearic, linolenic, elsanoic, galoleic, eurcic, hypogeic acid and the like. When the acid is carboxylic, having for example from 2 to 4 carboxy groups, the hydrocarbyl group is preferably a substituted or unsubstituted polymethylene. Fatty acids seem particularly suitable in preparing the ester of the invention.

Polyhydric alcohols useful in the practice of the invention are aliphatic, saturated or unsaturated, straight chain or branched alcohols having 3 to 10, preferably 3 to 6 and more preferably 3 to 4 hydroxyl groups, and having 3 to 90, preferably 3 to 30, and more preferably 3 to 12 carbon atoms in the molecule. It is particularly preferred that there be from 3 to 5 carbon atoms in the alcohol molecule. As set forth above, the polyhydric polyether backbone portion of the ester must have both ether oxygen and free hydroxyls, a combination not present in fuel economy additives of the prior art. Such polyhydric polyethers are derived from polyhydric alcohols having at least three hydroxyl groups. The monomeric compounds have the general formula $(RCH)_n[CH(OH)]_mCH_2OH_x$ wherein R is H or alkyl; n=0–10; m≧1, and x=≧2. Polyhydric alcohols include glycerine or glycerol, sugar alcohols and other polyhydric alcohols. While diglycerol, $HOCH_2CHOHCH_2OCH_2CHOHCH_2OH$, is well known, polyglycerols up to and including triacontaglycerol (30 condensed glycerol molecules) have been prepared commercially. In one embodiment of the invention, polyhydric polyether esters have been used which were prepared from glycerol to form an oligomer of glycerol having repeat units such as —[$CH_2CHOHCH_2O]_n$— and —[$CH_2CH(CH_2OH)O]_n$—, wherein the value of n ranges from three to ten and preferably from four to seven. Other useful polyhydric alcohols include, for example, pentaerythritol, triethylolethane, trimethylolpropane and the like, with commonly known polyhydric ether analogs being di- and tripentaerythritol and ditrimethylolpropane as illustrative, but nonlimiting examples. Most sugar alcohols have the general formula $HOCH_2(CHOH)_nCH_2OH$ wherein the value of n ranges from two to five. Sugar alcohols include tetritols, hexitols and pentitols.

The preparation of polyhydric polyethers and their esters is known to those skilled in the art. Thus, U.S. Pat. No. 3,637,774, the disclosure of which is incorporated herein by reference, discloses a method for preparing polyglycerols and polyglycerol esters which involves the intercondensation of glycerol in the presence of an alkaline catalyst in an anhydrous medium at elevated temperature. The water formed during the reaction is continuously removed. Suitable catalysts include alkali metal hydroxides, alcoholates, acetates, oxides and others. However, higher temperatures and longer reaction times can eliminate the need for a catalyst. The polyglycerol polyethers are oligomers. Oligomer is a term of art. An oligomer resembles a polymer except that the number of linked units is considerably smaller and removal of one or a few units affects the properties of the oligomer. The polyglycerols are esterified with one or more carboxylic acids, such as fatty acids, acid halides, acid anhydrides and other esters either by means of a direct esterification or by a transesterification reaction using conventional transesterification catalysts. Transesterification is sometimes preferred. It is a feature of the invention that the esters be partial esters and that the polyhydric polyether not be completely esterified. Polyhydric polyether esters are also prepared by condensing one or more polyhydric alcohols such as glycerine or glycerol in the presence of lithium compounds and then esterifying the oligomer or polymer by a transesterification reaction as is known to those skilled in the art and disclosed in PCT patent publication number WO 93/02124.

As set forth above, the polyhydric polyether backbone of the ester additive useful in the practice of the invention contains at least two, preferably at least three, and still more preferably at least four free hydroxyl groups which have not been esterified. In the example below, the ester additive of the invention is an oligomer of glycerol and specifically a decaglycerol oleate which contains an average of four adducted oleic acid units and from 10–12 free hydroxyl groups in the oligomer backbone. In one embodiment the polyhydric polyether portion of ester of the invention has from 2 to 20 free hydroxyl groups and in another embodiment from 3 to 15 hydroxyl groups. In another embodiment there are from 3 to 6 free hydroxyl groups. Each adducted acid, ester, anhydride, halide, etc. derivative unit has from 4 to 50 carbon atoms. In a narrower embodiment each adducted unit has from 10 to 30 or even from 10 to 22 carbon atoms. The polyhydric polyether portion of the ester molecule has from 3 to 90 carbon atoms and in other embodiments has from 3 to 30 carbon atoms. The polyhydric alcohol or alcohols from which the polyhydric polyether of the ester of the invention is derived will generally contain from 3 to 30 carbon atoms and more typically from 3 to 12 carbon atoms. The number of hydroxyl groups in the polyhydric alcohol will generally be from 3 to 10 and more typically from 3 to 6.

Fuels useful in the practice of the invention are typically petroleum hydrocarbon fuels useful for internal combustion engines, including fractions boiling in the gasoline, diesel and kerosine ranges. Fuels useful in the practice of the invention also include those derived from tar sand, shale oil, coal liquefaction, and the like, as well as various synthetic fuels and fuel components. Such fuels typically comprise mixtures of hydrocarbons of various types, including straight and branched chain paraffins, olefins, aromatic and napthenic hydrocarbons. These includes middle distillate fuels, such as diesel and jet fuels which boil within the range of from about 100° to 500° C. and more typically from about 150° to 400° C., as well as gasoline fuels. Gasoline fuel compositions are provided in a number of grades such as leaded and unleaded, and primarily unleaded gasoline, and are typically derived from heavy hydrocarbons such as crude oil, etc. as mentioned above, and are more typically derived from crude petroleum by conventional refining and blending processes as are well known to those skilled in the art and need not be mentioned here. Gasoline is defined as a mixture of liquid hydrocarbons or hydrocarbon oxygenates having an initial boiling point in the range of from about 70° to 135° F. and a final boiling point in the range of from about 250° to 450° F., as determined by the ASTM D86 distillation method. Fuel compositions useful in the practice of the invention include a major amount of a fuel (e.g., at least 90 wt. %) and various fuel additives. In addition to the polyhydric polyether ester of the invention, these additives typically include detergents, antioxidants, corrosion inhibitors, pour point depressants, color stabilizers and the like. In the practice of the invention, the fuel or fuel composition will contain from about 0.001 to about 10 wt. % of the polyhydric polyether ester additive, preferably from about 0.01 to 2 wt. %, and still more preferably from 0.05 to 1 wt. %.

The invention will be further understood by reference to the example below.

EXAMPLE

In this example, the ester additive of the invention is a decaglycerol tetraoleate made by esterifying decaglycerol with oleic acid. The ester backbone is an oligomer of glycerol, with an average of 10–12 free hydroxyl groups. The ester contains an average of four esterified or adducted oleic acid units. This compound is obtained from Karlshamns USA, Inc. in Columbus, Ohio as Caprol 10G40. Fuel economy is measured using a carburetted Buick 3.8 L V6 automotive, internal combustion engine in accord with a test procedure similar to the ASTM Sequence VI test. The tests are run at the "hot stage" of the test in which the sump temperature is 275° F. The oil used in the tests is ASTM HR which does not contain any friction reducing additive. The fuel is a Howell EEE base fuel gasoline, which is an unleaded gasoline and contains no additives. 1000 wt. ppm of the decaglycerol tetroleate ester additive of the invention is added to the fuel. Data is collected every hour over thirty minute periods for eight hours, at five minute intervals. Of each five minute interval, about two minutes are spent in data collection. The experiment is repeated with the same fuel, but which does not contain the decaglyerol tetroleate ester additive of the invention. The results of the engine tests show that the fuel containing the ester additive of the invention gives a fuel economy benefit of 1.8%.

Additional tests conducted in more modern engines, such as a Ford 4.6 liter V8 engine, also show that the ester additive is effective in reducing fuel consumption in all of the concentrations tested in the fuel, from as low as 100 mass ppm up to 1.2 wt. %.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A method for reducing fuel consumption in an internal combustion engine which comprises operating said engine on a fuel composition comprising a major amount of fuel to which has been added a minor amount of an additive comprising an ester of a polyhydric polyether, wherein said ester contains ether oxygens and free and esterified hydroxyl groups in the polyhydric polyether backbone portion of said ester.

2. A method according to claim 1 wherein the number of said free hydroxyls ranges from 3 to 20.

3. A method according to claim 2 wherein said ester is derived from the esterification of said polyhydric polyether with at least one organic compound selected from the group consisting essentially of a carboxylic acid, an acid halide, an acid anhydride, an ester and mixture thereof.

4. A method according to claim 3 wherein said ester has been added to said fuel composition in an amount of from 0.001 to 10 wt. %.

5. A method according to claim 4 wherein said organic compound contains from 10 to 30 carbon atoms and said polyhydric polyether contains from 6 to 90 carbons atoms.

6. A method according to claim 5 wherein said organic compound comprises a carboxylic acid having from 4 to 50 carbon atoms and said polyhydric polyether portion of said ester is derived from a polyhydric alcohol having from 3 to 10 hydroxyl groups.

7. A fuel composition comprising a major amount of fuel to which has been added a minor amount of an additive comprising an ester of a polyhydric polyether, wherein said ester contains ether oxygens and free and esterified hydroxyl groups in its polyhydric polyether backbone portion, and wherein said minor amount of said ester added is from 0.001 to 10 wt. %.

8. A fuel composition according to claim 7 wherein said ester is derived from the esterification of said polyhydric polyether with at least one organic compound selected from the group consisting essentially of a carboxylic acid, an acid halide, an acid anhydride, an ester and mixture thereof.

9. A fuel composition according to claim 8 wherein said polyhydric polyether comprises an oligomer of glycerol and wherein said organic compound comprises a carboxylic acid having from 10 to 30 carbon atoms.

10. A composition according to claim 9 wherein said carboxylic acid comprises oleic acid.

11. A method for reducing fuel consumption in an internal combustion engine which comprises operating said engine on a fuel composition comprising a major amount of fuel to which has been added a minor amount of an additive comprising an ester of a polyhydric polyether which contains both ether oxygens and free and esterified hydroxyl groups in the polyhydric polyether backbone portion of said ester, said ester having been prepared by condensing at least one polyhydric alcohol having at least three hydroxyl groups to form a polyhydric polyether and then partially esterifying the so-formed polyhydric polyether with at least one organic compound having from 10 to 30 carbon atoms selected from the group consisting essentially of a carboxylic acid, an acid halide, an acid anhydride and mixture thereof to form said ester, wherein the number of said free hydroxyl groups present on said backbone portion of said ester ranges from 3 to 20.

12. A method according to claim 11 wherein said polyhydric alcohol has the general formula $(RCH)_n[CH(OH)]_m(CH_2OH)_x$ wherein R is one or more of H or alkyl; n=0–10; $m \geqq 1$, and $x = \geqq 2$.

13. A method according to claim 11 wherein said polyhydric polyether is an oligomer of glycerol and contains one or more repeat units of $—[CH_2CHOHCH_2O]_y—$ and $[CH_2CH(CH_2OH)O]_y—$ wherein the value of y ranges from 3–10 and wherein said organic compound comprises oleic acid.

* * * * *